United States Patent [19]

Galdabini

[11] 4,154,073

[45] May 15, 1979

[54] AUTOMATIC STRAIGHTENING MACHINE

[76] Inventor: Renzo Galdabini, Via Ivrea 1-Gallarate, Varese, Italy

[21] Appl. No.: 831,288

[22] Filed: Sep. 7, 1977

[30] Foreign Application Priority Data

Jan. 21, 1977 [IT] Italy ..... 19546 A/77

[51] Int. Cl.[2] ..... B21D 3/10

[52] U.S. Cl. ..... 72/9; 72/389

[58] Field of Search ..... 72/9, 10, 11, 12, 18, 72/389

[56] References Cited

U.S. PATENT DOCUMENTS

| | | | |
|---|---|---|---|
| 1,551,715 | 9/1925 | Urschel | 72/389 |
| 3,208,250 | 9/1965 | Fournier | 72/10 |
| 3,316,743 | 5/1967 | Ovshinski | 72/10 |
| 3,335,587 | 8/1967 | Blachut et al. | 72/389 |
| 3,415,103 | 12/1968 | Crawford et al. | 72/8 |
| 3,481,170 | 12/1969 | Galdabini | 72/11 |
| 3,943,746 | 3/1976 | Eitel | 72/389 |
| 3,948,076 | 4/1976 | Eitel | 72/389 |

FOREIGN PATENT DOCUMENTS

| | | | |
|---|---|---|---|
| 50-29831 | 9/1975 | Japan | 72/12 |
| 311683 | 7/1969 | U.S.S.R. | 72/10 |

*Primary Examiner*—Michael J. Keenan

*Attorney, Agent, or Firm*—Cushman, Darby & Cushman

[57] ABSTRACT

An apparatus and method for straightening an elongated workpiece such as a crank shaft is disclosed. At least four measuring devices are disposed along the workpiece for measuring the position of four points on the workpiece relative to an axis extending between the ends of the workpiece. Signals from the measuring devices are converted to curvature signals representing the curvature of each section of the workpiece spanned by a sequence of three of the points, and straightening blows are applied as needed to sections of the workpiece to reduce or remove the curvatures. Subsequently the measuring devices may be employed to measure eccentricity at the four points and further straightening blows can be applied to reduce or remove eccentricity.

7 Claims, 5 Drawing Figures

AUTOMATIC STRAIGHTENING MACHINE

This invention relates to an automatic machine for straightening longitudinally extending pieces of round or nearly round cross-section such as shafts or mandrels.

Generally this operation is carried out by supporting the piece between centres or rollers to make a reference check, then applying straightening blows to it by a suitable hydraulic piston or punch which bends it against two suitable supports. The piece is disposed with its eccentricity upwards and the straightening blows, which are in a downward direction, induce bending forces in the piece beyond the elastic limit of the material, such as to reduce the eccentricity.

Each straightening blow is increased by an appropriate amount as determined by a blow programmer, such as that described in Italian Pat. No. 775.201, until the eccentricity is reduced to within acceptable limits.

In many cases, the requirement is for various points on the piece to be within predetermined eccentricity tolerances relative to the axis defined by the ends of the piece. The two points which define the reference axis may be central points formed by suitably machining the axial faces of the piece, or the geometrical central point of two cylindrical portions of the piece formed close to its ends. The centres or rollers supporting the piece are sprung so as not to become loaded by the force of the straightening blows, and to return elastically into the reference position.

According to the known art, in the first case the piece is gripped at its central points between a sprung head centre and tail centre, whereas in the second case it may be disposed on sprung rollers or V blocks. See for example German Pat. No. 1.061.156.

The eccentricity measurement is made by measuring devices disposed on the table supporting the head centre and tail centre, as these are influenced by any movement or positioning error of the head centre, tail centre or rollers.

Again according to the known art, a first series of straightening blows is applied at a first point to bring the eccentricity of the first point within the allowable tolerance, then a second series of blows is applied to a second point to bring the eccentricity of this point within the allowable tolerance, and this is repeated until all points are within the allowable tolerance.

However with this procedure it is impossible to prevent S bends being induced in the piece, and consequently on correcting the eccentricity at any determined point a new error is introduced into the previous point and so on, because of which the procedure is often a very long one.

According to the present invention for the straightening operation to be of maximum efficiency and speed, it is important for the machine to act at the points of unacceptable curvature of the piece rather than at the points in which eccentricity is greatest. Amongst other things, the elimination of localised curvature in the piece can lead to certain regions of the piece the eccentricities of which lie outside the allowable tolerance becoming disposed spontaneously in a central position.

It is therefore evident that an important problem in the straightening operation is to properly choose that region of the piece at which the machine is to operate, the sequence of operations in the various regions and the extent of the deformation impressed by each series of blows. All this reflects on the speed and accuracy of the straightening operation of the piece.

The object of the present invention is to provide an automatic straightening machine which applies blow series which are coordinated in terms of sequence and extent at the various points. This coordination prevents operation at any determined point from causing the eccentricity of the previous point to be thrown out of tolerance. At the same time the procedure is quicker, and avoids straightening those points which come within allowable tolerance by themselves during the straightening of the other points.

A further object of the present invention is to provide a straightening machine with a measuring system which makes the measurements independent of any positioning errors in the support members for the pieces (i.e. the head centre and tail centre).

To this end, the invention proposes to provide a straightening machine comprising supports for a piece of elongated form, arranged to vary the longitudinal and angular position of the piece relative to means for applying radial straightening blows to the piece, at least four measuring devices sensitive to the spacial position of respective sections of the piece, two of which are in proximity to the ends of the piece, means for calculating the eccentricity and curvature of the piece as a function of the measurement signals emitted by the position measuring devices, and selector means for controlling the variation in position of the piece and for controlling the means for applying the blows as a function of the eccentricity and curvature signals as processed by the means for calculating them.

The main advantages and structural characteristics of the machine according to the invention will be evident from the description given hereinafter of embodiments of the machine illustrated in the accompanying drawings in which.

Figure 1:
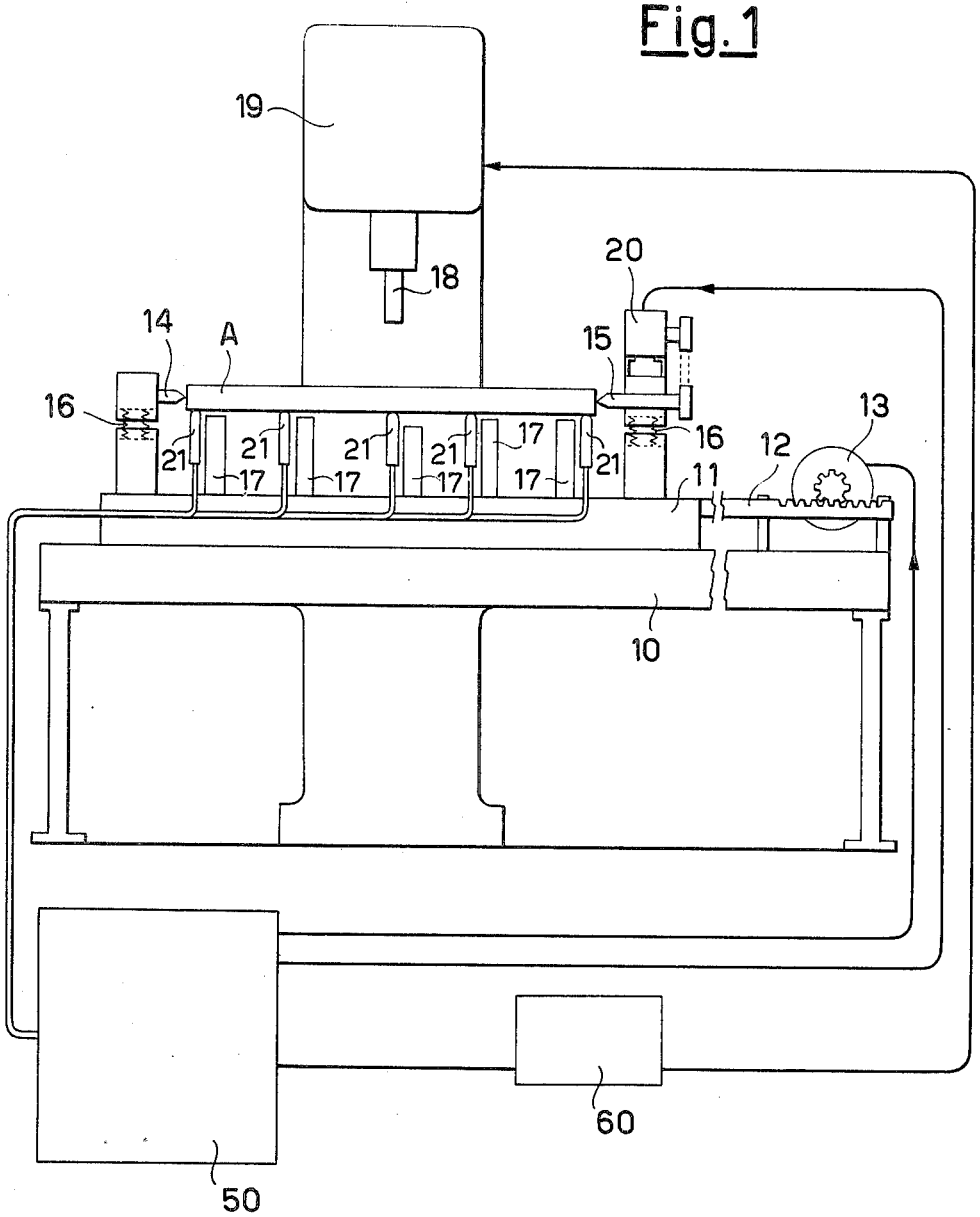
FIG. 1 is a diagrammatic view of a straightening machine according to the invention.
Figure 2:
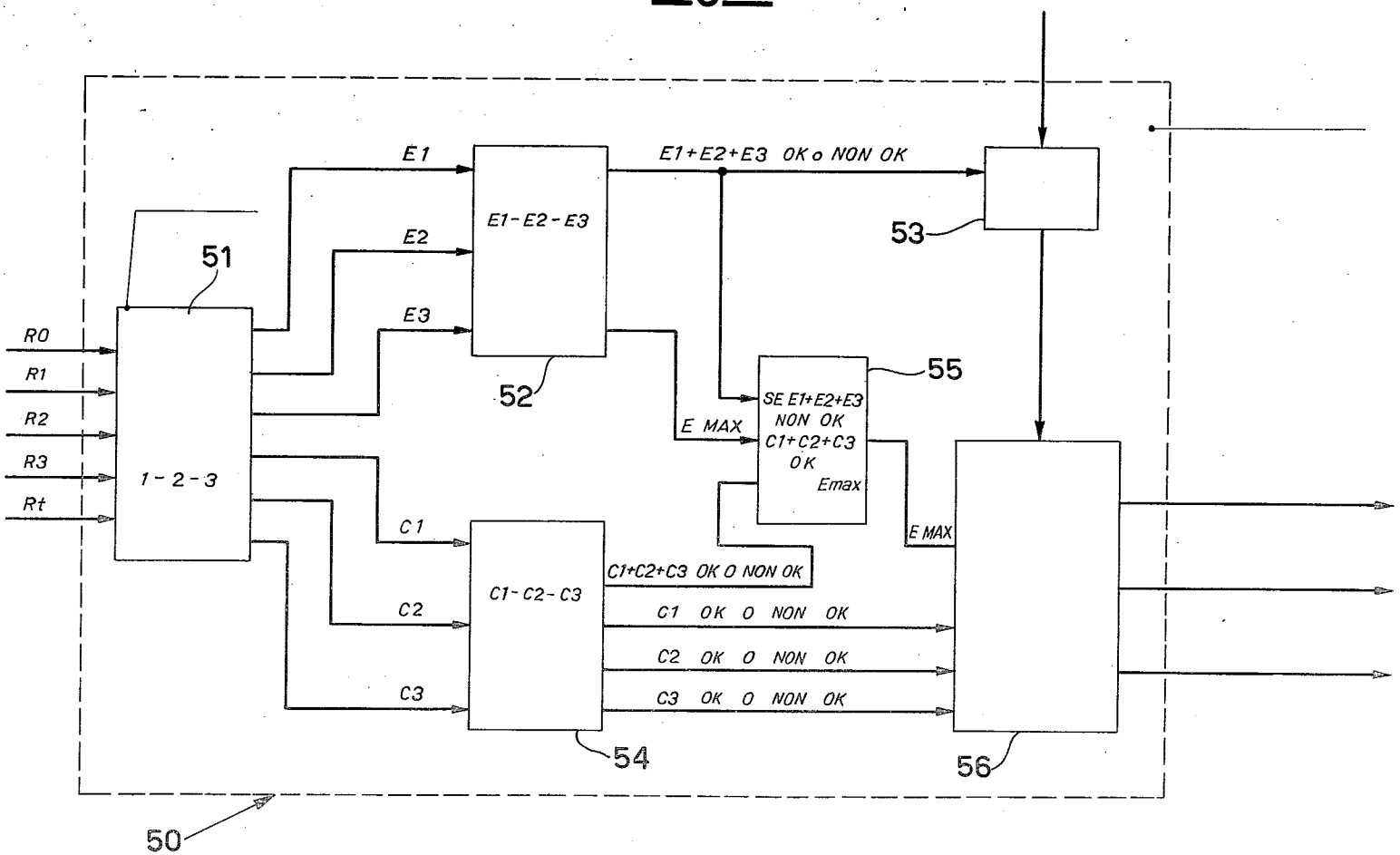
FIG. 2 shows a block diagram of the unit for monitoring and controlling the operation of the machine of FIG. 1.

FIG. 1 shows a straightening machine according to the invention, comprising a base 10 on which the table 11 slides rigid with a rack 12 which is driven by a motor 13. The supports 14 and 15 are mounted on the table via elastic means diagrammatically indicated at 16, and between which the piece A is supported.

Along the piece there are disposed removable supports 17 which support it when struck by the straightening punch 18 carried by the fixed column 19.

A motor 20 rotates the piece, via a suitable transmission, about the axis defined by the supports 14 and 15.

Finally, according to the invention, measuring devices 21 press on the piece A, two of these being in close proximity to the ends of the piece supported at 14 and 15.

The signals from the measuring devices are fed to a calculation and monitoring unit indicated overall by 50, which in its turn feeds control signals to the motors 13 and 15 and to the punch operating device via a blow programmer 60.

The unit 50 comprises a first calculation block 51 which, in accordance with the signals R0, R1, R2, R3 and Rt from the measuring devices 21, processes eccentricity signals E1, E2 and E3, and curvature signals C1, C2, C3, relative to the points measured by those measuring devices not at the ends.

The signals E are compared at 52 with limiting values set in accordance with the allowable straight-line tolerance of the piece.

52 emits a signal which, it at least one of the eccentricities E exceeds the tolerable value, causes the straightening process to proceed at 53. If E are within tolerance, the process is locked because no straightening is required.

The signals C are likewise compared at 54 with respective set curvature limit values, and a general signal is fed to the block 55 indicating whether all the curvatures are allowable or otherwise, plus signals to the selector block 56 indicating the allowability or otherwise of each individual curvature.

The block 56 controls the correction operation for the curvatures if these are outside tolerance, whereas if they are within tolerance, it passes a maximum eccentricity signal $E_{max}$ (received from 55).

The selector and programmer unit 56 controls the piece positioning members (motors 13 and 20) so that the piece becomes disposed such that the punch acts in the sense of annulling curvatures outside tolerance limits by striking in a predetermined sequence the regions in which the measuring devices R1, R2 and R3 act. The sequence may be fixed, i.e. acting in succession from the point of greatest curvature to the point of smallest curvature. The machine does not act where the curvature is already within tolerance. Having put the minor curvatures (i.e. C1, C2 and C3) to within allowable tolerance, the device becomes locked if simultaneously the E values have reached allowable tolerance. If this is not so, the programmer selector 56, again under the control of 53, controls the positioning of the piece and the operation of the punch in order to annul the eccentricity at at least one point of the piece, for example at a predetermined point or at the point where E is equal to $E_{max}$. With this operation the straightening is terminated.

Figure 3:
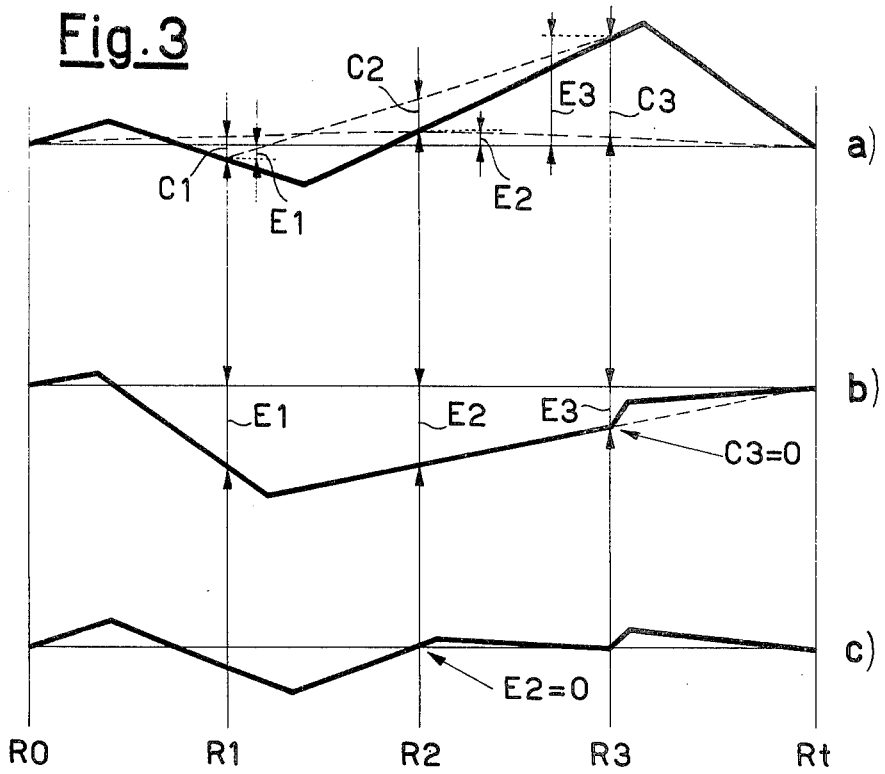
FIG. 3 shows the successive configurations of a piece during straightening by the machine of FIG. 1.

In order to better visualise the mode of action of the machine, FIG. 3 shows the straightening sequence for a piece.

This latter is shown at 3*a* in the deformed configuration, indicated diagrammatically as a broken line with the deviations from the straight-line exaggerated and coplanar for clarity of drawing.

Thus the sensors R1, R2, R3 sense the eccentricities E1, E2 and E3, with RO and Rt as reference.

The calculator 51 calculates the curvatures C1, C2 and C3.

It will be assumed that only C3 is outside the allowable tolerance. The machine does not act at points 1 and 2 but only annuls the curvature at 3 by a series of blows, and the piece thus assumes the configuration of 3*b*. All the curvatures are now within tolerance, but it will be assumed that at least the eccentricity E2 is outside tolerance. In this case the comparison signal emitted by 52 controls 53 for the straightening to proceed, simultaneously feeding the signal $E_{max}$ to 55 and 56. This latter again causes the punch to operate in order to annul E2, and the piece thus assumes the configuration shown in 3*c*. All the curvatures and eccentricities are now within the allowable tolerance and the block 53 terminates the straightening procedure.

The operation of the blow programmer 60 is well known to the art. It provides for the application of blow series with an intensity which increases in accordance with predetermined laws, as illustrated for example in the said Italian Pat. No. 775.201.

The structure of the straightening machine may also vary, providing it is equivalent functionally.

Figure 4:
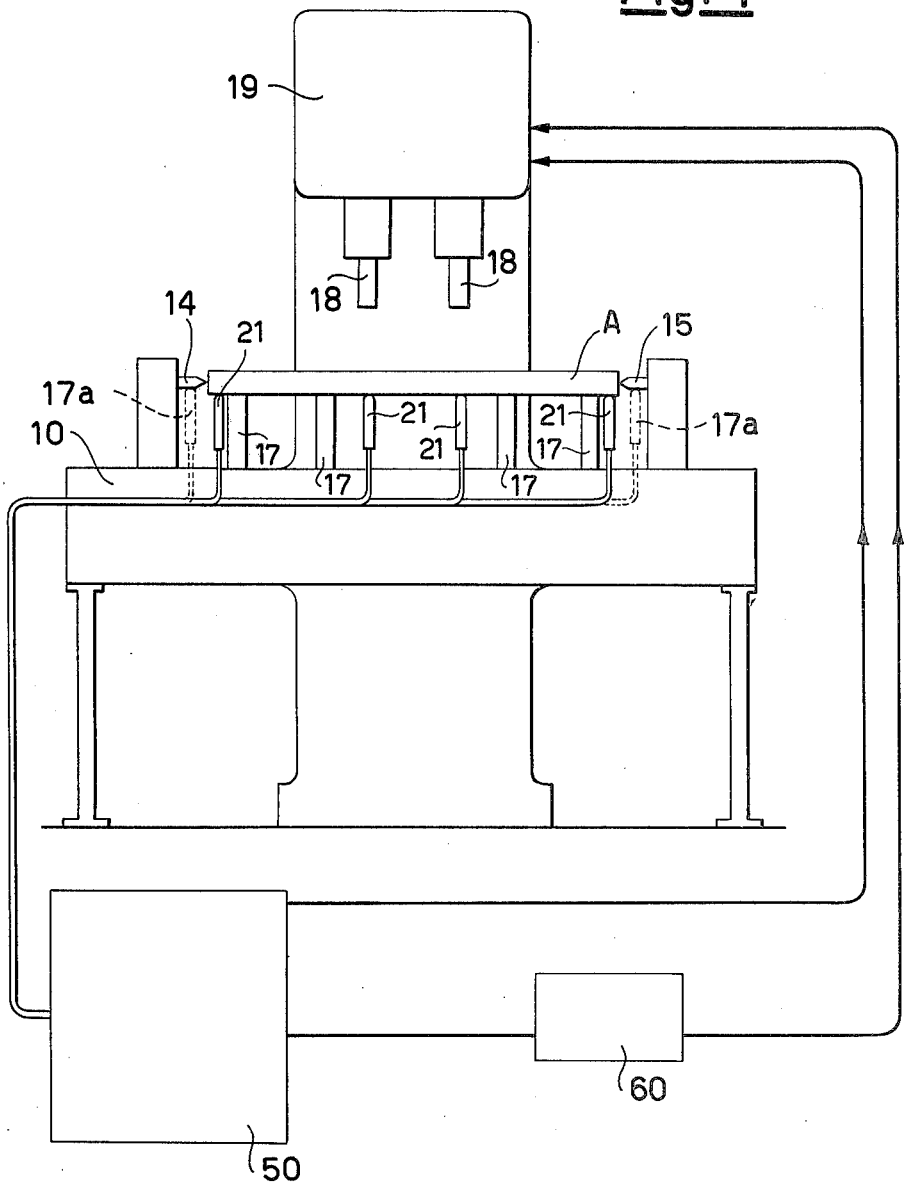

Thus for example, FIG. 4 shows a machine analogous to that of FIG. 1, but in which the table supporting the piece is not provided with movement of translation, and the selection of the longitudinal regions on the piece at which to act is determined by operating one or other of several punches. In the machine of FIG. 4, two punches 18*a* and 18*b* are shown, with the machine using only four sensors 21 and thus sensing only two eccentricities and two curvatures. Other parts of the machine of FIG. 3 are analogous to those of the machine of FIG. 1, and are indicated by the same reference numerals.

It can be seen in FIG. 4 that the end sensors can assume a position displaced from the piece (indicated by the dashed line 17*a*) and resting on the supports 14 and 15, and thus indirectly sensing the position of the end sections of the piece, centred on the supports.

Generally in the case of machines for straightening elongated pieces, the piece is supported by supports which act on the surface of the piece opposite the punch forces, and the supports are disposed to the side of the punch.

The supports may be moved manually, but in automatic machines it is preferable to selectively move a plurality of supports from a working position to a non-working position in accordance with the position of the punch.

Figure 5:
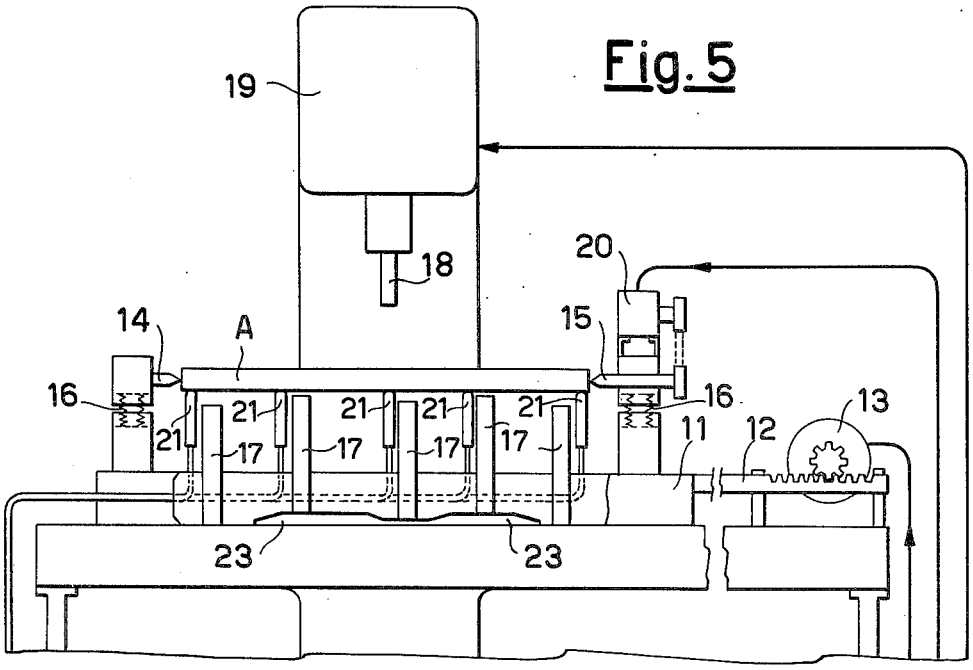
FIGS. 4 and 5 are views analogous to FIG. 1, showing machines analogous to those of FIG. 1.

FIG. 5 shows the supports mounted slidable vertically on the table 12, and the supports concerned are raised by engagement with cams 23 in the base 10.

As the head and tail centres are mounted on springs, in a manner known to the art, the adjacent supports have only to be brought close to the piece. At the beginning of each straightening blow, the head and tail centres move downwards, compressing their springs until the two highest supports touch the piece. The vertically mobile supports of FIG. 5 have various advantages. One of these is the fact that the reaction to the punch is transmitted directly to the structure of the press and does not load the support surface of the mobile table. In comparison with the forward and backward movements of normal extractable supports, the vertical movement allows the top of the supports to be given a cylindrical shape and a seat shaped such as to be able to transmit a high contact force to the piece when in the raised position, with minimum damage to its surface. Moreover, the automatic lifting of the supports is provided by the movement of the mobile table and simplifies the control and programming circuits over a system comprising a number of separate actuators for the forward and backward drive of the supports. Other parts of the machine of FIG. 5 are indicated by the same reference numerals as FIG. 1.

The embodiments heretofore described are given purely by way of example, and various functionally equivalent constructional modifications may be made thereto. In particular, the number of regions in which the eccentricity sensors are disposed may be varied, so varying the regions of operation of the punch or punches. The structure and configuration of the straightening machine may be modified, and to which all the functional concepts known to this field of the art may be applied.

What we claim is:

1. In an automatic machine for straightening an elongated workpiece of the kind including means for supporting the workpiece at its opposite ends, means for rotating the workpiece about the axis defined between said end supports, straightening means for applying radial straightening blows to the workpiece including at least one straightening punch and at least two supports for supporting the workpiece from the side opposite the punch, the improvement which comprises at least four measuring devices disposed longitudinally with respect to the workpiece for measuring the position of four longitudinally spaced points on the workpiece relative to said axis, two of the devices being located in proximity to the ends of the workpiece, calculation means responsive to the measuring devices for generating signals representing the curvature of each section of the workpiece spanned by each sequence of three points, and control means responsive to a curvature signal exceeding a predetermined value for operating said straightening means in a mode to annul said curvature signal.

2. A machine as in claim 1 wherein the measuring devices in proximity to the ends of the workpiece measure the position of the supports at said ends.

3. A machine as in claim 1 wherein said control means includes sequencer which determines in predetermined sequence those sections of the workpiece to be explored by said measuring devices and on which the straightening means acts.

4. A machine as in claim 1 wherein said calculation means includes means responsive to the measuring devices for generating signals representing the eccentricity of each of the four points relative to said axis, said machine further including means responsive to said eccentricity signals for preventing operation of said control means when all of said eccentricity signals have values less than a predetermined maximum.

5. A machine as in claim 1 wherein said calculation means includes means responsive to the measuring devices for generating signals representing the eccentricity of each of the four points relative to said axis, said machine including means operable after operation of said straightening means in said curvature-annulling mode, and in response to an eccentricity signal exceeding a predetermined value, for again operating said straightening means in a mode to annul said eccentricity signal.

6. A method for automatically straightening an elongated workpiece comprising measuring the positions of at least four points along the length of the workpiece relative to an axis defined by the ends of the workpiece, automatically converting the position measurements to signals representing the curvature of each section of the workpiece spanned by a sequence of three of said points, applying straightening blows by means of a straightening device to any section of the workpiece having a curvature exceeding a predetermined value in a mode to annul such curvature.

7. A method as in claim 6 including, after the step of annulling a curvature, automatically converting the position measurements to signals representing the eccentricity of each of said points relative to said axis and applying straightening blows to any point having an eccentricity which exceeds a predetermined maximum.

* * * * *